US007735155B2

(12) United States Patent
Kerkhoff

(10) Patent No.: US 7,735,155 B2
(45) Date of Patent: Jun. 15, 2010

(54) PANTS WITH ATTACHED SKIRT

(76) Inventor: Dean Kerkhoff, P.O. Box 4032, Covina, CA (US) 91723

( * ) Notice: Subject to any disclaimer, the term of this patent is extended or adjusted under 35 U.S.C. 154(b) by 973 days.

(21) Appl. No.: 11/317,354

(22) Filed: Dec. 23, 2005

(65) Prior Publication Data

US 2007/0157367 A1 Jul. 12, 2007

(51) Int. Cl.
*A41D 1/06* (2006.01)

(52) U.S. Cl. ..... 2/227; 2/48; 2/114

(58) Field of Classification Search ..... 2/67, 2/74, 70, 47, 71
See application file for complete search history.

(56) References Cited

U.S. PATENT DOCUMENTS

| | | | | | |
|---|---|---|---|---|---|
| 156,018 | A | | 10/1874 | Flynt | |
| 259,020 | A | * | 6/1882 | Hutton | 2/67 |
| 520,225 | A | * | 5/1894 | Sittig | 2/47 |
| 610,988 | A | | 9/1898 | Hoey | |
| 1,076,264 | A | | 10/1913 | Bolton | |
| 1,851,826 | A | | 3/1932 | Gardner | |
| 1,972,795 | A | * | 9/1934 | Rieffannacht | 2/67 |
| 2,211,966 | A | | 8/1940 | Attman | |
| 2,521,020 | A | * | 9/1950 | Prescott | 2/70 |
| 2,659,893 | A | * | 11/1953 | Hindman | 2/212 |
| 2,803,823 | A | | 8/1957 | Broadwin | |
| 2,835,897 | A | * | 5/1958 | Scruggs | 2/71 |
| 3,217,713 | A | | 11/1965 | Kunel | |
| 3,243,824 | A | | 4/1966 | Overholt | |
| 3,771,172 | A | * | 11/1973 | Barg | 2/67 |
| 3,774,241 | A | * | 11/1973 | Zerkle | 2/67 |
| D230,538 | S | | 3/1974 | Hansen | |
| 3,961,376 | A | * | 6/1976 | Howell | 2/71 |
| 4,028,740 | A | * | 6/1977 | Luerken | 2/67 |
| 4,459,703 | A | * | 7/1984 | Kosmas et al. | 2/48 |
| 4,689,829 | A | * | 9/1987 | Kaplan | 2/46 |
| 4,797,955 | A | | 1/1989 | Garrett | |
| 4,815,145 | A | | 3/1989 | Chow | |
| 5,327,586 | A | * | 7/1994 | Evans et al. | 2/211 |
| 5,566,393 | A | * | 10/1996 | Best | 2/74 |
| D378,317 | S | * | 3/1997 | Wike | D2/742 |
| D388,938 | S | | 1/1998 | De Scandiffio | |
| 5,717,998 | A | | 2/1998 | Evertt et al. | |
| 5,806,100 | A | * | 9/1998 | De Scandiffio | 2/211 |
| 5,983,392 | A | * | 11/1999 | Dutka | 2/69 |
| 5,991,920 | A | | 11/1999 | Holland | |
| 6,012,168 | A | * | 1/2000 | Hutton et al. | 2/114 |
| 6,240,560 | B1 | | 6/2001 | DeCaro | |
| D456,108 | S | | 4/2002 | Frederick | |
| D503,513 | S | * | 4/2005 | McCarthy | D2/735 |

* cited by examiner

*Primary Examiner*—Gary L Welch
*Assistant Examiner*—Richale L Quinn
(74) *Attorney, Agent, or Firm*—David A. Belasco; Belasco Jacobs & Townsley, LLP

(57) ABSTRACT

A pair of pants with attached skirt has first and second leg portions. Each of the leg portions has an inner side and an outer side. An abdominal portion has an upper end and a lower end and connects to the leg portions at the lower end. The abdominal portion has a waistband at the upper end. A skirt attaches to the waistband. When the pair of pants with attached skirt is worn, the skirt will cover a wearer's buttocks and thus provide modesty for the wearer. The skirt may surround the entire abdominal portion or may surround only the front or rear section of the abdominal portion. The skirt may be permanently or removably attached to the pants. The skirt may be formed at the rear as a pair of flaps meeting at a center point on the waistband.

5 Claims, 2 Drawing Sheets

PANTS WITH ATTACHED SKIRT

FIELD OF THE INVENTION

The invention pertains to articles of apparel. More particularly, the invention relates to pants for exercise or lounging with a half skirt attached for reasons of modesty.

BACKGROUND OF THE INVENTION

Various designs for pants and shorts with incorporated or detachable skirts have been developed by inventors. Some designs attempt to incorporate the fashion statement of a skirt with the utility of pants or shorts. Other designs attempt to provide a garment suitable for a variety of occasions. The present invention provides a short attached half skirt disposed over the buttocks to provide modesty during exercise workouts or similar activities.

U.S. Pat. No. 6,240,560, issued to DeCaro, discloses a swimsuit that is provided with a plurality of loop members and hook and loop fasteners for interchangeable attachment of straps, linked chains, and other accessories in a manner which alters the style and appearance of the swimsuit. The straps, linked chains, or the like are selectively attachable to the loops on a woman's swimsuit top to achieve various angles of lift so that the breasts are either moved closer together or separated, as desired by the wearer. The straps or linked chains are also attachable to loops on the swimsuit top and bottom to adjustably fit and secure the swimsuit top and bottom on the wearer. One or more closeable band wraps can be wrapped about the swimsuit top and/or bottom to achieve different swimsuit styles including a conventional style, a Brazilian cut or a thong. The hook and loop fasteners provide removable and interchangeable attachment of accessories including a mid-section between the top and bottom of a woman's swimsuit, a skirt, a full length gown, a sash, fabric panels including race numbers, or other accessories desired by the user.

U.S. Pat. No. D230,538, issued to Hansen is directed to the ornamental design of a pair of trunks. The trunks have an attached skirt that covers the front and the rear, but not the sides.

U.S. Pat. No. D378,317, issued to Wilke illustrates the ornamental design for a combination skirt and trousers. Fasteners at the top edge of the pants secure the skirt to the trousers. The skirt is split on each side, resulting in a front and a rear panel.

U.S. Pat. Nos. 5,806,100 and D388,938, issued to De Scandiffio disclose a combined skirt and shorts that are permanently sewn together at the upper part of the trunk, but are separated below the crotch so that the skirt amounts to a front and rear flap.

U.S. Pat. No. D503,513, issued to McCarthy is directed to the ornamental design for a combination skirt and pants. The skirt is coupled to the pants by means of side belts.

U.S. Pat. No. 1,076,264, issued to Bolton discloses a woman's outing suit that is of a one-piece construction comprising crotch pieces that cover the inner legs and side pieces that cover the outer legs and form a skirt. The edges of the panels have fasteners that can be detached in the front and/or the rear for greater freedom of movement of the legs.

It is an objective of the present invention to provide a pair of pants with an attached skirt. It is a further objective to provide such a pair of pants that is fashionable and provides a degree of modesty. It is a still further objective of the invention to provide a pair of pants with attached skirt that is suitable for both more formal and less formal occasions.

Finally, it is an objective of the present invention to provide such a pair of pants that is both durable and easily and inexpensively manufactured.

While some of the objectives of the present invention are disclosed in the prior art, none of the inventions found include all of the requirements identified.

SUMMARY OF THE INVENTION

The present invention addresses all of the deficiencies of prior art pants with attached skirt inventions and satisfies all of the objectives described above.

(1) A pair of pants with attached skirt providing the desired features may be constructed from the following components. A pair of pants is provided. The pants have first and second leg portions. Each of the leg portions has an inner side and an outer side. An abdominal portion is provided. The abdominal portion has an upper end and a lower end and connects to the leg sections at the lower end. The abdominal portion has a waistband at the upper end. A skirt is provided. The skirt attaches to the waistband. When the pair of pants with attached skirt is worn, the skirt will cover a wearer's buttocks and thus provide modesty for the wearer.

(2) In a variant of the invention, the skirt extends laterally along the waistband and surrounds the abdominal portion.

(3) In a further variant, the skirt extends laterally from a first point adjacent a center point of an outer side of the first leg portion to a second point adjacent a center point of an outer side of the second leg portion and extends downwardly toward the lower end of the abdominal portion.

(4) In still a further variant, the skirt is removably attached to the pair of pants.

(5) In yet a further variant, the skirt is permanently attached to the pair of pants.

(6) In a final variant of the invention, the skirt comprises first and second flap portions. The first flap portion extends laterally from a first point adjacent a center point of an outer side of the first leg portion to a center point on a rear portion of the waistband. The second flap portion extends laterally from the center point to a second point adjacent a center point of an outer side of the second leg portion. Each of the flap portions extends downwardly toward the lower end of the abdominal portion.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) As illustrated in FIGS. 1-6, a pair of pants with attached skirt 10 providing the desired features may be constructed from the following components. As illustrated in FIG. 1, a pair of pants 14 is provided. The pants 14 have first 18 and second 22 leg portions. Each of the leg portions 18, 22 has an inner side 26 and an outer side 30. An abdominal portion 34 is provided. The abdominal portion 34 has an upper end 38 and a lower end 42 and connects to the leg portions 18, 22 at the lower end 42. The abdominal portion 34 has a waistband 46 at the upper end 38. A skirt 50 is provided. The skirt 50 attaches to the waistband 46. When the pair of pants 14 with attached skirt 50 is worn, the skirt 50 will cover a wearer's buttocks 54 and thus provide modesty for the wearer 58.

Figure 1:
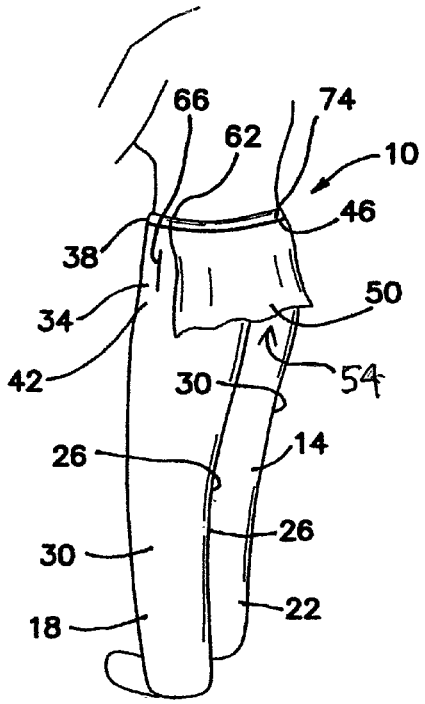
FIG. 1 is a perspective view of the preferred embodiment of the invention illustrating a skirt extending from one side of the waist of the wearer to an opposite, second side.
Figure 3:
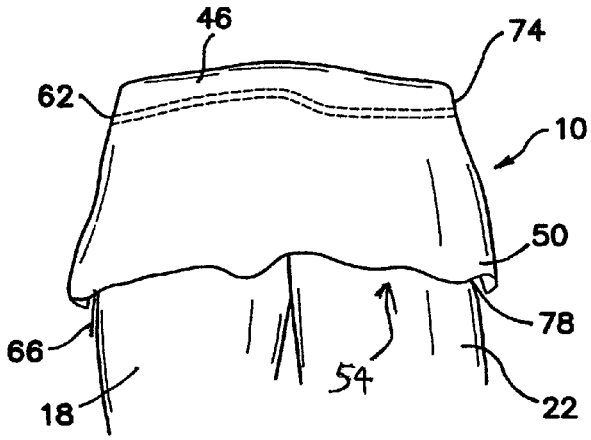
FIG. 3 is a rear elevational view of the FIG. 1 embodiment.
Figure 4:
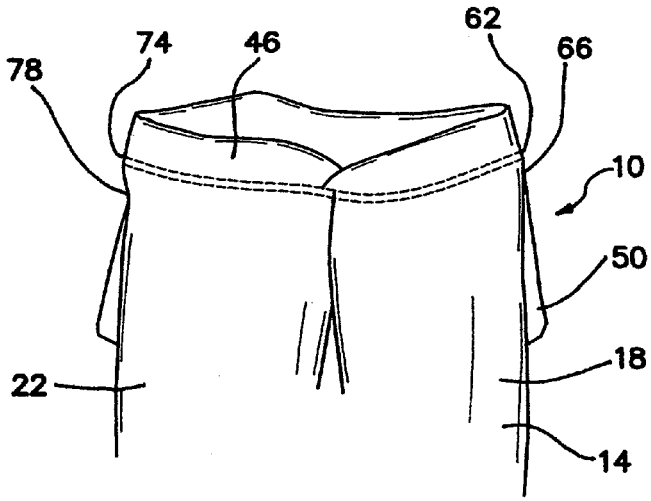
FIG. 4 is a front elevational view of the FIG. 1 embodiment.
Figure 2:
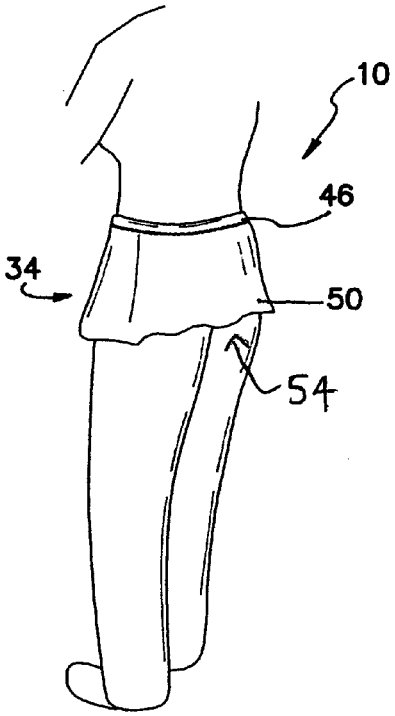
FIG. 2 is a perspective view of a second embodiment of the invention illustrating a skirt surrounding the waist of the wearer.

(2) In a variant of the invention, as illustrated in FIG. 2, the skirt 50 extends laterally along the waistband 46 and surrounds the abdominal portion 34.

(3) In a further variant, as illustrated in FIGS. 1 and 3-6, the skirt 50 extends laterally from a first point 62 adjacent a center point 66 of an outer side 30 of the first leg portion 18 to a second point 74 adjacent a center point 78 of an outer side 30 of the second leg portion 22 and extends downwardly toward the lower end 42 of the abdominal portion 34.

Figure 5:
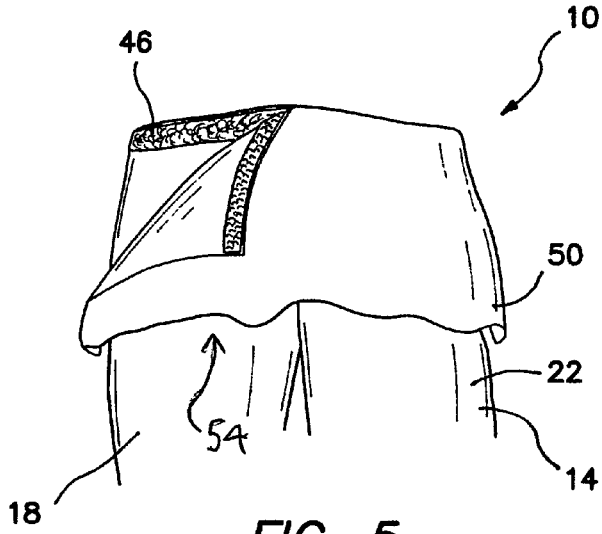
FIG. 5 is a rear elevational view of the FIG. 1 embodiment including a removably attached skirt.

(4) In still a further variant, as illustrated in FIG. 5, the skirt 50 is removably attached to the pair of pants 14.

(5) In yet a further variant, as illustrated in FIGS. 1-4 and 6, the skirt 50 is permanently attached to the pair of pants 14.

Figure 6:
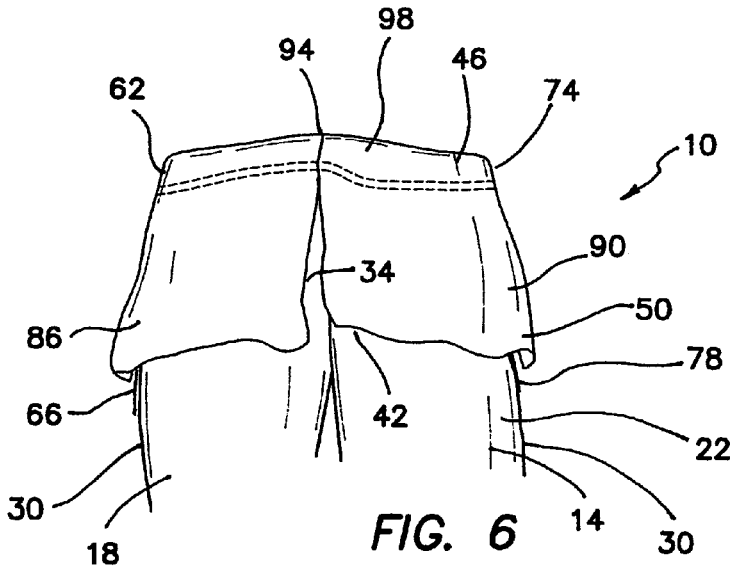
FIG. 6 is a rear elevational view of a third embodiment of the invention featuring a split skirt.

(6) In a final variant of the invention, as illustrated in FIG. 6, the skirt 50 comprises first 86 and second 90 flap portions. The first flap portion 86 extends laterally from a first point 62 adjacent a center point 66 of an outer side 30 of the first leg portion 18 to a center point 94 on a rear portion 98 of the waistband 46. The second flap portion 90 extends laterally from the center point 94 to a second point 74 adjacent a center point 78 of an outer side 82 of the second leg portion 22. Each of the flap portions 86, 90 extends downwardly toward the lower end 42 of the abdominal portion 34.

The pair of pants with attached skirt 10 has been described with reference to particular embodiments. Other modifications and enhancements can be made without departing from the spirit and scope of the claims that follow.

The invention claimed is:

1. A garment, comprising:

a pair of pants, said pants having first and second leg portions, each of said leg portions covering the legs of a wearer and having an inner side and an outer side, and an abdominal portion, said abdominal portion having an upper end and a lower end, connecting to said leg sections at said lower end, and having a waistband at said upper end;

a half-skirt, said half-skirt extending laterally around the rear of said wearer's body from a first point adjacent a center point of an outer side of said first leg portion to a second point adjacent a center point of an outer side of said second leg portion; said half-skirt attaching to said waistband and extending downwardly to said lower end of said abdominal portion so that said half-skirt just covers said wearer's buttocks;

whereby, when said garment is worn, said half-skirt will provide modesty for said wearer.

2. The garment, as described in claim 1, wherein said half-skirt further extends laterally around the front of said wearer's body from a first point adjacent a center point of an outer side of said first leg portion to a second point adjacent a center point of an outer side of said second leg portion and surrounds said abdominal portion.

3. The garment, as described in claim 1, wherein said half-skirt is removably attached to said pair of pants.

4. The garment, as described in claim 1, wherein said half-skirt is permanently attached to said pair of pants.

5. The garment, as described in claim 1, wherein said half-skirt comprises a first flap and a second flap, said first flap extending laterally from a first point adjacent a center point of an outer side of said first leg portion to a center point on a rear of said waistband, said second flap extending laterally from a second point adjacent a center point of an outer side of said second leg portion to said center point on said rear of said waistband to.

* * * * *